US011183327B2

(12) United States Patent
Katsuta

(10) Patent No.: US 11,183,327 B2
(45) Date of Patent: Nov. 23, 2021

(54) COIL COMPONENT

(71) Applicant: Murata Manufacturing Co., Ltd., Kyoto-fu (JP)

(72) Inventor: Mizuho Katsuta, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 226 days.

(21) Appl. No.: 16/125,616

(22) Filed: Sep. 7, 2018

(65) Prior Publication Data

US 2019/0080838 A1 Mar. 14, 2019

(30) Foreign Application Priority Data

Sep. 12, 2017 (JP) ..... JP2017-175099

(51) Int. Cl.
*H01F 27/32* (2006.01)
*H01F 27/28* (2006.01)
(Continued)

(52) U.S. Cl.
CPC ..... *H01F 27/323* (2013.01); *H01F 1/34* (2013.01); *H01F 17/0013* (2013.01);
(Continued)

(58) Field of Classification Search
CPC ..... H01F 1/34; H01F 17/04; H01F 17/0013; H01F 2017/0026; H01F 27/323;
(Continued)

(56) References Cited

U.S. PATENT DOCUMENTS 7,375,608 B2 * 5/2008 Suzuki ..... H01F 17/0013 336/200
2004/0061587 A1 * 4/2004 Hong ..... H01F 17/0013 336/200
(Continued)

FOREIGN PATENT DOCUMENTS

JP 2006-210403 A 8/2006
JP 2006-210541 A 8/2006
(Continued)

OTHER PUBLICATIONS

An Office Action; "Notification of Reasons for Refusal," by the Japanese Patent Office dated Nov. 26, 2019, which corresponds to Japanese Patent Application No. 2017-175099 and is related to U.S. Appl. No. 16/125,616; with English language translation.

*Primary Examiner* — Mang Tin Bik Lian
(74) *Attorney, Agent, or Firm* — Studebaker & Brackett PC

(57) ABSTRACT

A coil component includes a multilayer body that includes a first outer magnetic body, a first outer insulator, a first inner magnetic body, an inner insulator, a second inner magnetic body, a second outer insulator, and a second outer magnetic body which are stacked sequentially in the stacking direction and a coil disposed inside the inner insulator. A thickness of the first outer insulator is from about one-fifteenth to one-seventh a total thickness of the first outer magnetic body, the first outer insulator, and the first inner magnetic body. Also, a thickness of the second outer insulator is from about one-fifteenth to one-seventh a total thickness of the second outer magnetic body, the second outer insulator, and the second inner magnetic body.

20 Claims, 5 Drawing Sheets

(51) Int. Cl.

| | |
|---|---|
| ***H01F 1/34*** | (2006.01) |
| ***H01F 27/24*** | (2006.01) |
| ***H01F 17/00*** | (2006.01) |
| ***H01F 27/29*** | (2006.01) |
| ***H01F 17/04*** | (2006.01) |

(52) U.S. Cl.
CPC ..... *H01F 17/04* (2013.01); *H01F 27/24* (2013.01); *H01F 27/2804* (2013.01); *H01F 27/292* (2013.01); *H01F 2027/2809* (2013.01)

(58) Field of Classification Search
CPC .... H01F 27/2804; H01F 27/24; H01F 27/292; H01F 2027/2809
USPC ..... 336/200, 223, 233
See application file for complete search history.

(56) References Cited

U.S. PATENT DOCUMENTS

2005/0068148 A1* 3/2005 Yoshida ..... H01F 17/0013 336/200
2009/0003191 A1* 1/2009 Inuzuka ..... H01F 17/0013 369/283
2009/0283306 A1* 11/2009 Nishino ..... C03C 8/04 174/257
2010/0201473 A1* 8/2010 Konoue ..... H01F 5/00 336/200
2011/0181384 A1* 7/2011 Inuduka ..... H01F 17/0013 336/234
2013/0015935 A1* 1/2013 Chang ..... H01F 17/0013 336/200
2014/0176283 A1* 6/2014 Yang ..... H01F 17/0033 336/200
2014/0191838 A1* 7/2014 Yoshida ..... H01F 27/2804 336/200
2016/0049234 A1* 2/2016 Kawashima ..... H01F 17/0013 336/200
2016/0372254 A1* 12/2016 Harada ..... H01F 17/0013
2017/0330669 A1* 11/2017 Tomonari ..... H01F 27/36

FOREIGN PATENT DOCUMENTS

JP 2006-319009 A 11/2006
JP 2013-062459 A 4/2013
JP 2015-207574 A 11/2015
JP 2016-213333 A 12/2016

* cited by examiner

COIL COMPONENT

CROSS-REFERENCE TO RELATED APPLICATION

This application claims benefit of priority to Japanese Patent Application No. 2017-175099, filed Sep. 12, 2017, the entire content of which is incorporated herein by reference.

BACKGROUND

Technical Field

The present disclosure relates to a coil component.

Background Art

An existing coil component is described in Japanese Unexamined Patent Application Publication No. 2013-62459. That is, Japanese Unexamined Patent Application Publication No. 2013-62459 describes a common mode noise filter including at least a first insulating layer which contains glass and an inorganic filler and in which a plurality of pores are present, a pair of coil conductors where each conductor is disposed on an opposite surface of the first insulating layer, and oxide magnetic layers disposed above and below the first insulating layer provided with the pair of the coil conductors. In the common mode noise filter described in Japanese Unexamined Patent Application Publication No. 2013-62459, second insulating layers, which contain glass and an inorganic filler and in which a plurality of pores are present, are disposed between the first insulating layer provided with the pair of coil conductors and the oxide magnetic layers.

In the common mode noise filter described in Japanese Unexamined Patent Application Publication No. 2013-62459, each of the oxide magnetic layers disposed above and below the first insulating layer provided with the pair of the coil conductors has a configuration in which a plurality of layers are disposed with two insulating layers containing a glass component interposed therebetween. When such a configuration is adopted, the firing shrinkage behavior of the oxide magnetic layers composed of a material different from the first insulating layer approaches the behavior of the first insulating layer so as to provide advantages in integral co-firing.

However, when two insulating layers containing a glass component are disposed in each of the oxide magnetic layers, the chip height of the common mode noise filter increases, and there is a problem in that a low-profile chip is not easily produced. In addition, when two insulating layers containing a glass component are disposed in each of the oxide magnetic layers, the thickness of the magnetic layer is reduced, and there is a problem in that it is difficult to increase the impedance of a common mode component.

SUMMARY

Accordingly, the present disclosure provides a coil component enabling achievement of relaxation of stress during co-firing, an improvement in electrical characteristics, and production of a low-profile chip in a balanced manner.

According to preferred embodiments of the present disclosure, a coil component includes a multilayer body that includes a first outer magnetic body, a first outer insulator, a first inner magnetic body, an inner insulator, a second inner magnetic body, a second outer insulator, and a second outer magnetic body which are stacked sequentially in the stacking direction and a coil disposed inside the inner insulator. The thickness of the first outer insulator is about one-fifteenth or more and one-seventh or less (i.e., from about one-fifteenth to one-seventh) the total thickness of the first outer magnetic body, the first outer insulator, and the first inner magnetic body, and the thickness of the second outer insulator is about one-fifteenth or more and one-seventh or less (i.e., from about one-fifteenth to one-seventh) the total thickness of the second outer magnetic body, the second outer insulator, and the second inner magnetic body.

Regarding the coil component of the above-described embodiment, when the thickness of the first outer insulator, which is a single layer disposed under the inner insulator, and the thickness of the second outer insulator, which is a single layer disposed over the inner insulator, are each set to be within a predetermined range, stress applied to the inner insulator can be reduced, the electrical characteristics of the coil component can be improved, and a low-profile coil component can be achieved.

In an embodiment of the coil component, the distance between the first outer insulator and the inner insulator is preferably about one-third or more and one-half or less (i.e., from about one-third to one-half) the total thickness of the first outer magnetic body, the first outer insulator, and the first inner magnetic body. Also, the distance between the second outer insulator and the inner insulator is preferably about one-third or more and one-half or less (i.e., from about one-third to one-half) the total thickness of the second outer magnetic body, the second outer insulator, and the second inner magnetic body.

Regarding the above-described embodiment, when the distance between the first outer insulator and the inner insulator, and the distance between the second outer insulator and the inner insulator, are each set to be within a predetermined range, a reduction in stress applied to the inner insulator and an improvement in electrical characteristics of the coil component can be achieved in a balanced manner.

According to preferred embodiments of the present disclosure, a coil component includes a multilayer body that includes a first outer magnetic body, a first outer insulator, a first inner magnetic body, an inner insulator, a second inner magnetic body, a second outer insulator, and a second outer magnetic body which are stacked sequentially in the stacking direction and a coil disposed inside the inner insulator. The thickness of each of the first outer insulator and the second outer insulator is about 10 μm or more and 20 μm or less (i.e., from about 10 μm to 20 μm).

Regarding the coil component of the above-described embodiment, when the thickness of the first outer insulator, which is a single layer disposed under the inner insulator, and the thickness of the second outer insulator, which is a single layer disposed over the inner insulator, are each set to be within a predetermined range, stress applied to the inner insulator can be reduced. Also, the electrical characteristics of the coil component can be improved, and a low-profile coil component can be achieved.

In an embodiment of the coil component, the distance between the first outer insulator and the inner insulator is preferably about 55 μm or more and 75 μm or less (i.e., from about 55 μm to 75 μm), and the distance between the second outer insulator and the inner insulator is preferably about 55 μm or more and 75 μm or less (i.e., from about 55 μm to 75 μm). According to this embodiment, when the distance between the first outer insulator and the inner insulator, and the distance between the second outer insulator and the inner insulator, are each set to be within a predetermined range, a reduction in stress applied to the inner insulator and an improvement in electrical characteristics of the coil component can be achieved in a balanced manner.

According to preferred embodiments of the present disclosure, a coil component includes a multilayer body that includes a first outer insulator, a first inner magnetic body, an inner insulator, a second inner magnetic body, and a second outer insulator which are stacked sequentially in the stacking direction and a coil disposed inside the inner insulator. The thickness of each of the first outer insulator and the second outer insulator is about 1 μm or more and 20 μm or less (i.e., from about 1 μm to 20 μm). The multilayer body may further includes a first outer magnetic body disposed on the first outer insulator and a second outer magnetic body disposed on the second outer insulator.

Regarding the coil component of the above-described embodiment, when the thickness of the first outer insulator, which is a single layer disposed under the inner insulator, and the thickness of the second outer insulator, which is a single layer disposed over the inner insulator, are each set to be within a predetermined range, stress applied to the inner insulator can be reduced. Also, the electrical characteristics of the coil component can be improved, and a low-profile coil component can be achieved.

In an embodiment of the coil component, the distance between the first outer insulator and the inner insulator is preferably about one-half or more the total thickness of the first outer insulator, the first inner magnetic body, and, when disposed, the first outer magnetic body. Also, the distance between the second outer insulator and the inner insulator is preferably about one-half or more the total thickness of the second outer insulator, the second inner magnetic body, and, when disposed, the second outer magnetic body.

According to the above-described embodiment, when the distance between the first outer insulator and the inner insulator, and the distance between the second outer insulator and the inner insulator, are each set to be within a predetermined range, a reduction in stress applied to the inner insulator and an improvement in electrical characteristics of the coil component can be achieved in a balanced manner.

In an embodiment of the coil component, the distance between the first outer insulator and the inner insulator is preferably about 37.5 μm or more, and the distance between the second outer insulator and the inner insulator is preferably about 37.5 μm or more. According to this embodiment, when the distance between the first outer insulator and the inner insulator, and the distance between the second outer insulator and the inner insulator, are each set to be within a predetermined range, a reduction in stress applied to the inner insulator and an improvement in electrical characteristics of the coil component can be achieved in a balanced manner.

In an embodiment, preferably, the coil component further includes an internal magnetic body disposed inside the inner circumference of the coil in the inner insulator and connected to the first inner magnetic body and the second inner magnetic body. According to this embodiment, the coil component includes an internal magnetic body. Therefore, the electrical characteristics of the coil component can be further improved.

In an embodiment of the coil component, preferably, the distance between the first outer insulator and the inner insulator, in a region inside the inner circumference of the coil when viewed from above (i.e., along an axis extending in a direction in which the insulators in the coil component are stacked), is larger than the distance between the first outer insulator and the inner insulator in a region in accord with the inner insulator that is not in the region inside the inner circumference of the coil when viewed from above. Likewise, the distance between the second outer insulator and the inner insulator, in the region inside the inner circumference of the coil when viewed from above (i.e., along the axis extending in the direction in which the insulators in the coil component are stacked), is larger than the distance between the second outer insulator and the inner insulator, in the region in accord with the inner insulator that is not in the region inside the inner circumference of the coil when viewed from above. According to this embodiment, the distance between the first outer insulator and the inner insulator, and the distance between the second outer insulator and the inner insulator, are each large in a region inside the inner circumference of the coil. Therefore, stress applied to the inner insulator can be reduced, the electrical characteristics of the coil component can be further improved, and a low-profile coil component can be achieved.

In an embodiment, the coil component further includes an internal magnetic body disposed inside the inner circumference of the coil in the inner insulator and connected to the first inner magnetic body and the second inner magnetic body. The distance between the first outer insulator and the inner insulator, at the center of the internal magnetic body when viewed from above, is larger than the distance between the first outer insulator and the inner insulator, in a region in accord with the inner insulator not at the center of the internal magnetic body when viewed from above. Likewise, the distance between the second outer insulator and the inner insulator, at the center of the internal magnetic body when viewed from above, is larger than the distance between the second outer insulator and the inner insulator, in the region in accord with the inner insulator not at the center of the internal magnetic body when viewed from above.

According to the above-described embodiment, each of the distance between the first outer insulator and the inner insulator, and the distance between the second outer insulator and the inner insulator, is large at the center of the internal magnetic body. Therefore, stress applied to the inner insulator can be reduced, the electrical characteristics of the coil component can be further improved, and a low-profile coil component can be achieved.

In an embodiment of the coil component, it is preferable that the first inner magnetic body, the second inner magnetic body, and, when disposed, the first outer magnetic body. The second outer magnetic body, and the internal magnetic body contain Ni-Cu-Zn-based ferrite, and the first outer insulator and the second outer insulator contain alkali borosilicate glass. According to this embodiment, the high-frequency characteristics of the coil component can be improved.

Other features, elements, characteristics and advantages of the present disclosure will become more apparent from the following detailed description of preferred embodiments of the present disclosure with reference to the attached drawings.

DETAILED DESCRIPTION

Figure 1:
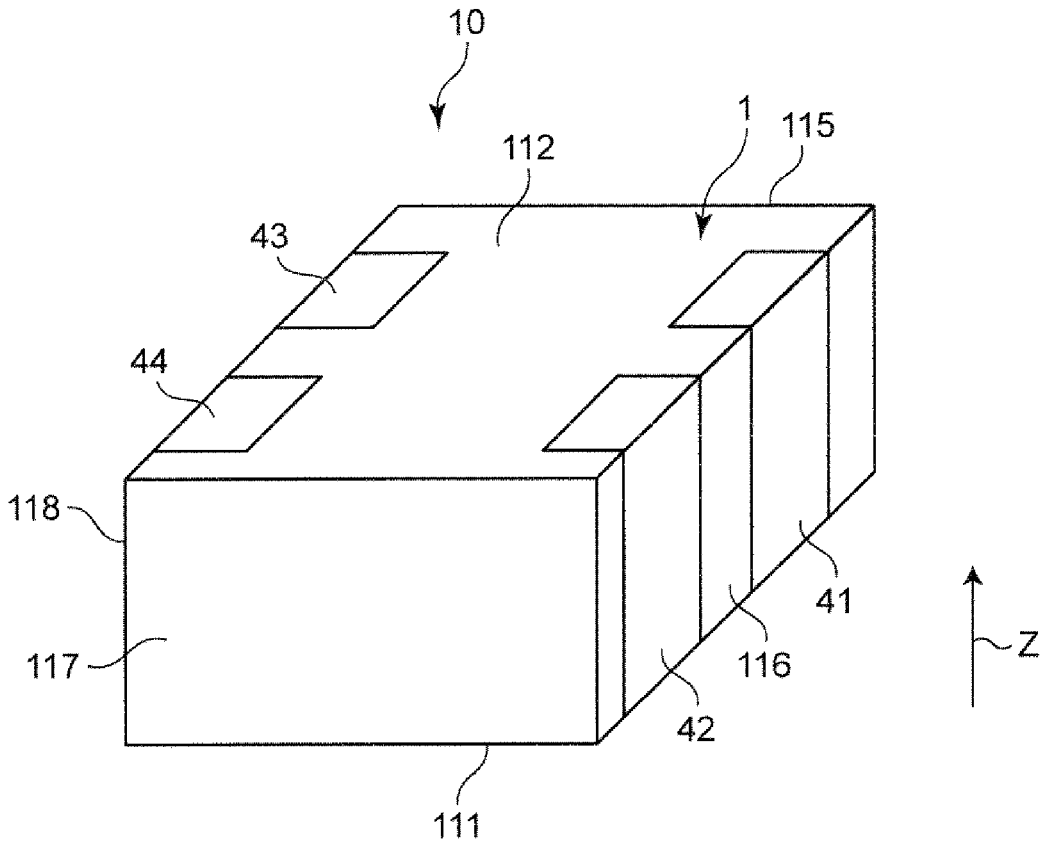
FIG. 1 is a perspective view showing a coil component according to a first embodiment of the present disclosure.

The present disclosure will be described below in detail with reference to the embodiments shown in the drawings. In this regard, the shapes, arrangements, and the like of the coil component and constituents according to the present disclosure are not limited to the embodiments described below or to the illustrated configurations, and the design can be changed within the scope of the present disclosure.

First Embodiment

Figure 2:
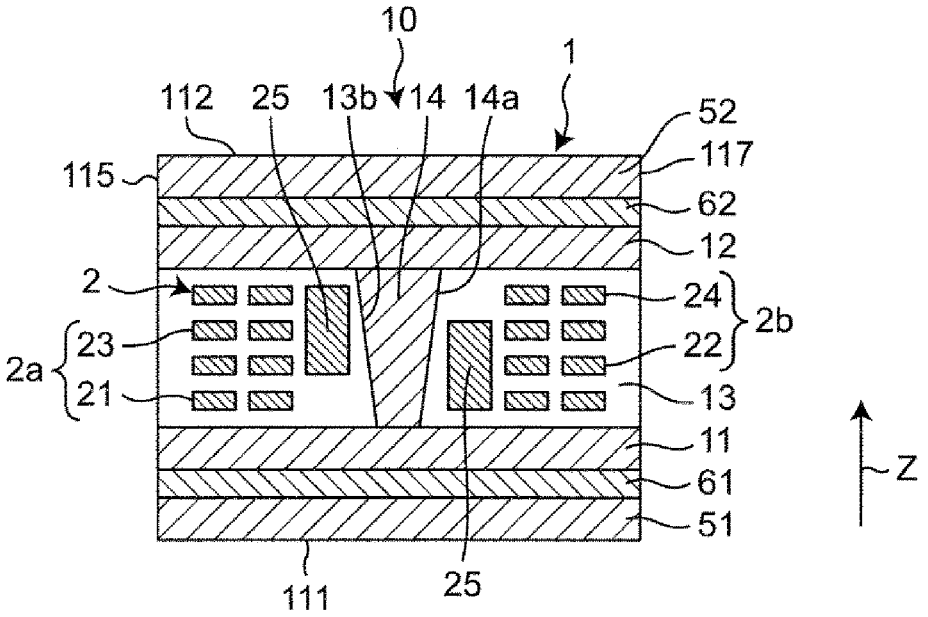
FIG. 2 is a sectional view showing a coil component.
Figure 3:
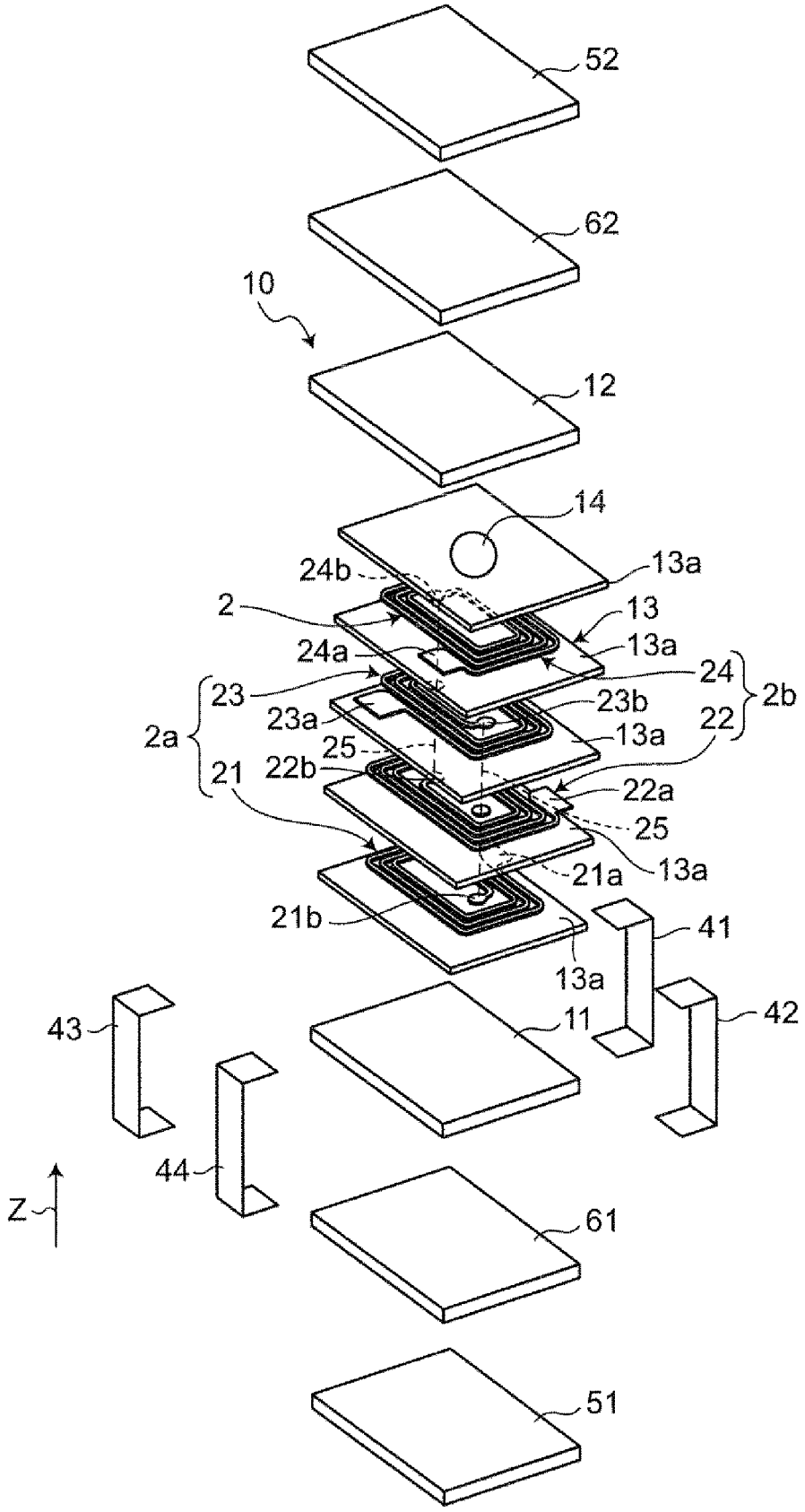
FIG. 3 is an exploded perspective view showing a coil component.

FIG. 1 is a perspective view showing a coil component 10 according to a first embodiment of the present disclosure. FIG. 2 is a sectional view showing the coil component 10. FIG. 3 is an exploded perspective view showing the coil component 10. As shown in FIGS. 1 to 3, the coil component 10 includes a multilayer body 1, a coil 2 disposed inside the multilayer body 1, and first to fourth outer electrodes 41 to 44 disposed on the surface of the multilayer body 1.

The coil component 10 is a common mode choke coil. In this regard, the coil component according to the present embodiment is not limited to the common mode choke coil and may include a single coil. The coil component 10 may be mounted in electronic equipment, e.g., a personal computer, a DVD player, a digital camera, a television, a cellular phone, and car electronics.

The multilayer body 1 includes a first outer magnetic body 51, a first outer insulator 61, a first inner magnetic body 11, an inner insulator 13, a second inner magnetic body 12, a second outer insulator 62, and a second outer magnetic body 52, which are stacked sequentially in the stacking direction (indicated by arrow Z in the drawing). An internal magnetic body 14 is disposed in the inner insulator 13. The first outer magnetic body 51 is located at a lower position, and the second outer magnetic body 52 is located at an upper position. The lower side is mounted on, for example, a mounting substrate.

The first inner magnetic body 11, the second inner magnetic body 12, the first outer magnetic body 51, the second outer magnetic body 52, and the internal magnetic body 14 may contain, for example, Ni-Cu-Zn-based ferrite. Consequently, the high-frequency impedance characteristics of the coil component 10 can be improved. Preferably, the first inner magnetic body 11, the second inner magnetic body 12, the first outer magnetic body 51, the second outer magnetic body 52, and the internal magnetic body 14 are composed of Ni-Cu-Zn-based ferrite. The first inner magnetic body 11, the second inner magnetic body 12, the first outer magnetic body 51, the second outer magnetic body 52, and the internal magnetic body 14 may have the same composition or compositions different from each other.

Preferably, the Ni-Cu-Zn-based ferrite contains Fe, Ni, Zn, and Cu as primary components and contains Fe as about 40% to 49.5% by mole of $Fe_2O_3$, Zn as about 5% to 35% by mole of ZnO, and Cu as about 6% to 13% by mole of CuO, where the remainder is Ni (in the form of NiO). In addition, additives may be included, and it is preferable that Si as $SiO_2$ in a mole fraction of about 1.0 to 3.0 parts and Mn as $Mn_3O_4$ in a mole fraction of about 0.05 to 1.0 parts be included relative to 100 parts of the total of $Fe_2O_3$, ZnO, CuO, and NiO.

The first outer insulator 61, the second outer insulator 62, and the inner insulator 13 are composed of, for example, glass containing alkali borosilicate glass and can decrease the dielectric constant, reduce the stray capacitance of the coil, and improve the high-frequency characteristics. The inner insulator 13 is formed by stacking a plurality of insulating layers 13*a*.

The alkali borosilicate glass contains at least Si, B, and K, where Si as about 65% to 85% by mole of $SiO_2$, B as about 20% to 30% by mole of $B_2O_3$, and K as about 0.5% to 2.0% by mole of $K_{20}$ are included. In addition, it is preferable that Al as $Al_2O_3$ in a mole fraction of about 0.5 to 1.5 parts and Mg as MgO in a mole fraction of about 1.0 to 3.0 parts be included relative to 100 parts of the total of $SiO_2$, $B_2O_3$, and $K_2O$. Regarding the alkali borosilicate glass, a predetermined ratio of $SiO_2$—$B_2O_3$—$K_2O$ glass may be produced, and $SiO_2$ serving as a filler may be added thereto. That is, the final ratio of Si, B, and K has only to fall within the above-described range.

The internal magnetic body 14 is disposed inside the inner circumference of the coil 2 in the inner insulator 13 and is connected to the first inner magnetic body 11 and the second inner magnetic body 12. Specifically, a hole 13*b* that passes through the inner insulator 13 in the stacking direction is located in a portion inside the inner circumference of the coil 2 in the inner insulator 13. The internal magnetic body 14 is disposed inside the hole 13*b*. In a cross section parallel to the stacking direction, the width of the internal magnetic body 14 increases continuously from the first inner magnetic body 11 side toward the second inner magnetic body 12 side. That is, the inner diameter of the hole 13*b* located inside the inner insulator 13 increases continuously from the first inner magnetic body 11 side toward the second inner magnetic body 12 side in a direction parallel to the stacking direction, and the internal magnetic body 14 is disposed along the inner circumference of the hole 13*b*.

The shape of the multilayer body 1 is a substantially rectangular parallelepiped. As shown, for example, in FIG. 1, the surface of the multilayer body 1 is composed of a first end surface 111, a second end surface 112, a first side surface 115, a second side surface 116, a third side surface 117, and a fourth side surface 118. The first end surface 111 and the second end surface 112 are located opposite to each other in the stacking direction. The first to fourth side surfaces 115 to 118 are located substantially perpendicular to the first end surface 111 and the second end surface 112. The first end surface 111 is located at a lower position in the stacking direction, and the second end surface 112 is located at an upper position.

The multilayer body 1 is a substantially rectangular parallelepiped having a length L of about 0.80±0.10 mm, a width W of about 0.60±0.10 mm, and a height T of about 0.45±0.05 mm or a substantially rectangular parallelepiped having a length L of about 0.60±0.10 mm, a width W of about 0.50±0.10 mm, and a height T of about 0.35±0.05 mm.

As shown, for example, in FIG. 2, the coil 2 is disposed inside the inner insulator 13. The coil 2 includes a primary coil 2*a* and a secondary coil 2*b* magnetically coupled to each other. The primary coil 2*a* and the secondary coil 2*b* are disposed so as to overlap one another in the stacking direction of the multilayer body 1.

The primary coil 2*a* includes a first coil conductor layer 21 and a third coil conductor layer 23 electrically connected to each other. The secondary coil 2*b* includes a second coil conductor layer 22 and a fourth coil conductor layer 24 electrically connected to each other.

The first to fourth coil conductor layers 21 to 24 are arranged sequentially in the stacking direction. That is, two coil conductor layers (first coil conductor layer 21 and third coil conductor layer 23) constituting the primary coil 2*a* and two coil conductor layers (second coil conductor layer 22 and fourth coil conductor layer 24) constituting the secondary coil 2*b* are arranged alternately in the stacking direction. The first to fourth coil conductor layers 21 to 24 are disposed on the respective insulating layers 13*a* different from each other. The first to fourth coil conductor layers 21 to 24 may be composed of an electrically conductive material, for example, Ag, Ag—Pd, Cu, or Ni. The first to fourth coil conductor layers 21 to 24 may have the same composition or compositions different from each other.

The first to fourth coil conductor layers 21 to 24 have a spiral pattern which is a spiral winding on a plane when viewed from above. As can be appreciated from the description herein, the term "viewed from above" as used herein can be construed as corresponding to a direction along arrow Z (i.e., along the stacking direction). The center axes of the first to fourth coil conductor layers 21 to 24 are in accord with each other when viewed from above. That is, the first to fourth coil conductor layers 21 to 24 overlap one another in the stacking direction. The characteristics of the coil component 10 can be optionally changed because such a configuration is adopted.

As shown, for example, in FIG. 3, a first end 21*a* of the first coil conductor layer 21 extends outside the outer circumference of the spiral pattern, and a second end 21*b* of the first coil conductor layer 21 is located inside the inner circumference of the spiral pattern. Likewise, the second coil conductor layer 22 has a first end 22*a* and a second end 22*b*, the third coil conductor layer 23 has a first end 23*a* and a second end 23*b*, and the fourth coil conductor layer 24 has a first end 24*a* and a second end 24*b*. The first end 21*a* of the first coil conductor layer 21 is exposed at the second side surface 116 at a position near the first side surface 115. The first end 22*a* of the second coil conductor layer 22 is exposed at the second side surface 116 at a position near the third side surface 117. The first end 23*a* of the third coil conductor layer 23 is exposed at the fourth side surface 118 at a position near the first side surface 115. The first end 24*a* of the fourth coil conductor layer 24 is exposed at the fourth side surface 118 at a position near the third side surface 117.

The second end 21*b* of the first coil conductor layer 21 is electrically connected to the second end 23*b* of the third coil conductor layer 23 with a connection conductor 25, which passes through the insulating layer 13*a*, interposed therebetween. Likewise, the second end 22*b* of the second coil conductor layer 22 is electrically connected to the second end 24*b* of the fourth coil conductor layer 24 with a connection conductor 25, which passes through the insulating layer 13*a*, interposed therebetween. As described above, the coil 2 is composed of the first to fourth coil conductor layers 21 to 24 and the connection conductors 25.

In the coil component 10 shown in FIGS. 1 to 3, each of the primary coil 2*a* and the secondary coil 2*b* is composed of two flat-surface coils. However, at least one of the primary coil 2*a* and the secondary coil 2*b* may be composed of one flat-surface coil or three or more flat-surface coils. In addition, in the coil component 10 shown in FIGS. 1 to 3, the coil 2 includes four coil conductor layers, but the coil 2 has only to include at least one coil conductor layer. In the coil component 10 shown in FIGS. 1 to 3, the shapes of all the coil conductor layers are the same. However, the shape of at least one coil conductor layer may be different from the shapes of the other coil conductor layers.

The first to fourth outer electrodes 41 to 44 may be composed of an electrically conductive material, for example, Ag, Ag—Pd, Cu, or Ni. The first to fourth outer electrodes 41 to 44 may have the same composition or compositions different from each other. The first to fourth outer electrodes 41 to 44 may be formed by, for example, coating the surface of the multilayer body 1 with the electrically conductive material and performing baking.

The first outer electrode 41 is disposed on the second side surface 116 at a position near the first side surface 115. One end of the first outer electrode 41 extends to the first end surface 111, and the other end of the first outer electrode 41 extends to the second end surface 112. In other words, the shape of the first outer electrode 41 on the surface of the multilayer body 1 is substantially the shape of the letter U. The first outer electrode 41 is electrically connected to the first end 21*a* of the first coil conductor layer 21.

Likewise, the second outer electrode 42 is disposed on the second side surface 116 at a position near the third side surface 117 and is electrically connected to the first end 22*a* of the second coil conductor layer 22. The third outer electrode 43 is disposed on the fourth side surface 118 at a position near the first side surface 115 and is electrically connected to the first end 23*a* of the third coil conductor layer 23. The fourth outer electrode 44 is disposed on the fourth side surface 118 at a position near the third side surface 117 and is electrically connected to the first end 24*a* of the fourth coil conductor layer 24.

The first outer insulator 61 is disposed between the first outer magnetic body 51 and the first inner magnetic body 11. Likewise, the second outer insulator 62 is disposed between the second outer magnetic body 52 and the second inner magnetic body 12. When the first outer insulator 61 and the second outer insulator 62 are disposed as described above, a difference in shrinkage between the inner insulator 13 and the magnetic body (first inner magnetic body 11, second inner magnetic body 12, first outer magnetic body 51, and second outer magnetic body 52) is reduced and stress that may be generated during firing of the multilayer body can be reduced, and as a result, generation of cracking and chipping in the multilayer body can be suppressed.

As the thickness of each of the first outer insulator 61 and the second outer insulator 62 increases, the effect of reducing stress tends to be enhanced. On the other hand, if the thickness of each of the first outer insulator 61 and the second outer insulator 62 increases, the size of the entire coil component increases such that achievement of a low-profile chip becomes difficult. In addition, if the thickness of each of the first outer insulator 61 and the second outer insulator 62 increases, the thickness of the magnetic body decreases relatively, and as a result, the electrical characteristics of the coil component may be degraded. Regarding the coil component according to the present embodiment, when the thickness of each of the first outer insulator 61 and the second outer insulator 62 is optimized, stress applied to the inner insulator 13 can be reduced, the electrical characteristics of the coil component can be improved, and a low-profile coil component can be achieved. When the coil component is a common mode choke coil, the impedance of the common mode component can be increased by adopting the above-described configuration.

Specifically, the thickness of the first outer insulator 61 is preferably about one-fifteenth or more and one-seventh or less (i.e., from about one-fifteenth to one-seventh) the total thickness of the first outer magnetic body 51, the first outer insulator 61, and the first inner magnetic body 11. Likewise, the thickness of the second outer insulator 62 is preferably about one-fifteenth or more and one-seventh or less (i.e., from about one-fifteenth to one-seventh) the total thickness of the second outer magnetic body 52, the second outer insulator 62, and the second inner magnetic body 12. When the thickness of the outer insulator is set to be within the above-described range, stress applied to the inner insulator 13 can be reduced, the electrical characteristics of the coil component can be improved, and a low-profile coil component can be achieved.

Alternatively, the thickness of the first outer insulator 61 and the thickness of the second outer insulator 62 are preferably about 10 μm or more and 20 μm or less (i.e., from about 10 μm to 20 μm). When the thickness of each of the outer insulators is set to be within the above-described range, stress applied to the inner insulator 13 can be reduced, the electrical characteristics of the coil component can be improved, and a low-profile coil component can be achieved.

As the distance between the first outer insulator 61 and the inner insulator 13 and the distance between the second outer insulator 62 and the inner insulator 13 (hereafter also collectively referred to as a "distance between the outer insulator and the inner insulator") decrease, the effect of reducing stress tends to be enhanced, while the electrical characteristics tend to be degraded. Meanwhile, if the distance between the outer insulator and the inner insulator increases, the size of the entire coil component increases such that achievement of a low-profile chip becomes difficult. When the distance between the outer insulator and the inner insulator is optimized, stress applied to the inner insulator 13 can be reduced, the electrical characteristics of the coil component can be improved, and a low-profile coil component can be achieved. When the coil component is a common mode choke coil, the impedance of the common mode component can be increased by adopting the above-described configuration.

Specifically, the distance between the first outer insulator 61 and the inner insulator 13 is preferably about one-third or more and one-half or less (i.e., from about one-third to one-half) the total thickness of the first outer magnetic body 51, the first outer insulator 61, and the first inner magnetic body 11. Likewise, the distance between the second outer insulator 62 and the inner insulator 13 is preferably about one-third or more and one-half or less (i.e., from about one-third to one-half) the total thickness of the second outer magnetic body 52, the second outer insulator 62, and the second inner magnetic body 12. When the distance between the outer insulator and the inner insulator is set to be within the above-described range, stress applied to the inner insulator 13 can be reduced, the electrical characteristics of the coil component can be improved, and a low-profile coil component can be achieved.

Alternatively, the distance between the first outer insulator 61 and the inner insulator 13 is preferably about 55 μm or more and 75 μm or less (i.e., from about 55 μm to 75 μm). Likewise, the distance between the second outer insulator 62 and the inner insulator 13 is preferably about 55 μm or more and 75 μm or less (i.e., from about 55 μm to 75 μm). When the distance between the outer insulator and the inner insulator is set to be within the above-described range, stress applied to the inner insulator 13 can be reduced, the electrical characteristics of the coil component can be improved, and a low-profile coil component can be achieved.

Preferably, the coil component 10 further includes the internal magnetic body 14 disposed inside the inner circumference of the coil 2 in the inner insulator 13 and connected to the first inner magnetic body 11 and the second inner magnetic body 12. When the internal magnetic body 14 is included, the electrical characteristics of the coil component 10 can be further improved.

The height of the multilayer body 1 of the coil component according to the present embodiment is preferably about 0.30 mm or more and 0.50 mm or less (i.e., from about 0.30 mm to 0.50 mm). The distance between the first outer insulator 61 and the first end surface 111 of the multilayer body 1 is preferably about one-third or more and one-half or less the total thickness of the first outer magnetic body 51, the first outer insulator 61, and the first inner magnetic body 11. Likewise, the distance between the second outer insulator 62 and the second end surface 112 of the multilayer body 1 is preferably about one-third or more and one-half or less (i.e., from about one-third to one-half) the total thickness of the second outer magnetic body 52, the second outer insulator 62, and the second inner magnetic body 12. Alternatively, the distance between the first outer insulator 61 and the first end surface 111 of the multilayer body 1 is preferably about 55 μm or more and 75 μm or less (i.e., from about 55 μm to 75 μm). Likewise, the distance between the second outer insulator 62 and the second end surface 112 of the multilayer body 1 is preferably about 55 μm or more and 75 μm or less (i.e., from about 55 μm to 75 μm).

In the present specification, the thickness of each of the first outer insulator 61 and the second outer insulator 62 refers to an average thickness in a cross section parallel to the stacking direction of the multilayer body 1. The thickness of each of the first outer insulator 61 and the second outer insulator 62 can be determined, for example, as an average value calculated from measurement values, where each thickness is measured at equidistant 5 positions in a direction perpendicular to the stacking direction in a cross section that is parallel to the second side surface 116 of the multilayer body 1 and that is located at the center between the second side surface 116 and the fourth side surface 118. The thickness of each of the first outer magnetic body 51, the second outer magnetic body 52, the first inner magnetic body 11, and the second inner magnetic body 12 can be determined in the same manner. Each of the distance between the first outer insulator 61 and the inner insulator 13 and the distance between the second outer insulator 62 and the inner insulator 13 refers to the minimal distance in a cross section parallel to the stacking direction of the multilayer body 1. The distance between the outer insulator and the inner insulator can be measured in, for example, a cross section that is parallel to the second side surface 116 of the multilayer body 1 and that is located at the center between the second side surface 116 and the fourth side surface 118. Each of the distance between the first outer insulator 61 and the first end surface 111 of the multilayer body 1 and the distance between the second outer insulator 62 and the second end surface 112 of the multilayer body 1 refers to the minimal distance in a cross section parallel to the stacking direction of the multilayer body 1. The distance between the outer insulator and the end surface of the multilayer body 1 can be measured in, for example, a cross section that is parallel to the second side surface 116 of the multilayer body 1 and that is located at the center between the second side surface 116 and the fourth side surface 118.

Next, a method for manufacturing the coil component 10 will be described.

As shown in FIGS. 2 and 3, the first outer insulator 61 and the first inner magnetic body 11 are stacked sequentially on the first outer magnetic body 51. Subsequently, a plurality of insulating layers 13*a* provided with the respective coil conductor layers 21 to 24 by plating are stacked sequentially on the first inner magnetic body 11. As a result, the inner insulator 13 in which the coil 2 is disposed is formed on the first inner magnetic body 11.

Thereafter, a laser is applied from above the inner insulator 13 downward so as to form a hole 13*b* that vertically passes through the inner insulator 13. The hole 13*b* may be formed by mechanical processing. The resulting hole 13*b* is filled with the internal magnetic body 14, and the second inner magnetic body 12, the second outer insulator 62, and the second outer magnetic body 52 are stacked sequentially on the inner insulator 13 so as to form the multilayer body 1. The multilayer body 1 is fired, and the outer electrodes 41 to 44 are formed on the surface of the multilayer body 1. The coil component 10 can be produced in this manner.

Second Embodiment

Figure 4:
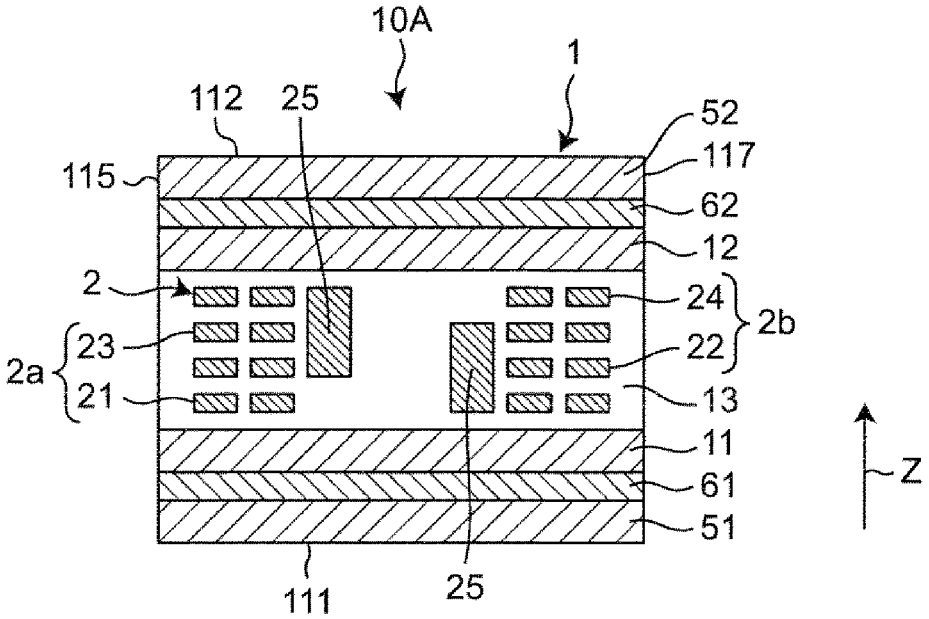
FIG. 4 is a sectional view showing a coil component according to a second embodiment of the present disclosure.

FIG. 4 is a sectional view showing a coil component according to a second embodiment of the present disclosure. The second embodiment is different from the first embodiment in that the coil component includes no internal magnetic body. Only the differences in the configuration will be described below. In the second embodiment, the same reference numerals as those in the first embodiment denote the same configurations as in the first embodiment, and explanations thereof will not be provided.

As shown in FIG. 4, a coil component 10A according to the second embodiment includes no internal magnetic body 14. Also, in the coil component 10A according to the present embodiment, the multilayer body 1 includes the first outer insulator 61 and the second outer insulator 62 and, therefore, stress applied to the inner insulator 13 can be reduced, the electrical characteristics of the coil component can be improved, and a low-profile coil component can be achieved. When the coil component is a common mode choke coil, the impedance of the common mode component can be increased by adopting the above-described configuration.

Third Embodiment

Figure 5:
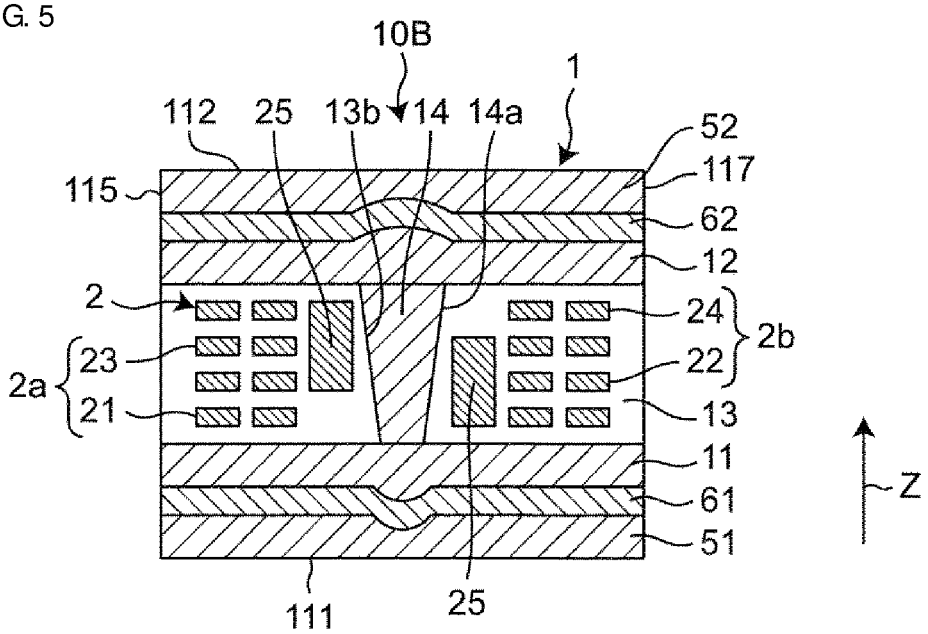
FIG. 5 is a sectional view showing a coil component according to a third embodiment of the present disclosure.

FIG. 5 is a sectional view showing a coil component according to a third embodiment of the present disclosure. The third embodiment is different from the first embodiment in that the distance between the first outer insulator and the inner insulator, in a region inside the inner circumference of the coil when viewed from above (i.e., in a direction along arrow Z), is larger than the distance between the first outer insulator and the inner insulator, in a region in accord with the inner insulator that is not inside the inner circumference of the coil when viewed from above. Likewise, the distance between the second outer insulator and the inner insulator, in the region inside the inner circumference of the coil when viewed from above, is larger than the distance between the second outer insulator and the inner insulator, in the region in accord with the inner insulator that is not inside the inner circumference of the coil when viewed from above. Only the differences in the configuration will be described below. In the third embodiment, the same reference numerals as those in the first embodiment denote the same configurations as in the first embodiment, and explanations thereof will not be provided.

As shown in FIG. 5, regarding a coil component 10B according to the third embodiment, the distance between the first outer insulator 61 and the inner insulator 13, in a region inside the inner circumference of the coil 2 when viewed from above, is larger than the distance between the first outer insulator 61 and the inner insulator 13, in a region in accord with the inner insulator 13 that is not inside the inner circumference of the coil 2 when viewed from above. Likewise, the distance between the second outer insulator 62 and the inner insulator 13, in the region inside the inner circumference of the coil 2 when viewed from above, is larger than the distance between the second outer insulator 62 and the inner insulator 13, in the region in accord with the inner insulator 13 that is not inside the inner circumference of the coil 2 when viewed from above. Specifically, the distance between the first outer insulator 61 and the inner insulator 13, at the center of the internal magnetic body 14 when viewed from above, is larger than the distance between the first outer insulator 61 and the inner insulator 13, in a region in accord with the inner insulator 13 that is not at the center of the internal magnetic body 14 when viewed from above. Likewise, the distance between the second outer insulator 62 and the inner insulator 13, at the center of the internal magnetic body 14 when viewed from, is larger than the distance between the second outer insulator 62 and the inner insulator 13, in the region in accord with the inner insulator 13 that is not at the center of the internal magnetic body 14 when viewed from above.

When the distance between the first outer insulator 61 and the inner insulator 13, and the distance between the second outer insulator 62 and the inner insulator 13, are each set to be relatively small in the region in accord with the inner insulator 13, as described above, the effect of reducing stress applied to the inner insulator 13 can be ensured. Also, the electrical characteristics of the coil component 10B can be improved by setting the distance between the first outer insulator 61 and the inner insulator 13, and the second outer insulator 62 and the inner insulator 13, to each be relatively large in the region inside the inner circumference of the coil 2, where a magnetic flux is generated. That is, the electrical characteristics of the coil component 10B can be further enhanced while stress applied to the inner insulator is reduced. When the coil component 10B is a common mode choke coil, the impedance of the common mode component can be increased to a great extent. Further, even when the distance between the first outer insulator 61 and the inner insulator 13, and the distance between the second outer insulator 62 and the inner insulator 13, are each set as described above, the height of the coil component 10B is not affected to a great extent and, therefore, a low-profile coil component 10B can be realized at the same time.

In the present embodiment, the distance between the first outer insulator 61 and the inner insulator 13 in the region inside the inner circumference of the coil 2 (center of the internal magnetic body 14) when viewed from above is preferably 1 time or more and 1.2 times or less (i.e., from 1 time to 1.2 times) the distance between the first outer insulator 61 and the inner insulator 13 in the region in accord with the inner insulator 13 that is not inside the inner circumference of the coil 2 when viewed from above. Likewise, the distance between the second outer insulator 62 and the inner insulator 13 in the region inside the inner circumference of the coil 2 (center of the internal magnetic body 14) when viewed from above is preferably 1 time or more and 1.2 times or less (i.e., from 1 time to 1.2 times) the distance between the second outer insulator 62 and the inner insulator 13 in the region in accord with the inner insulator 13 that is not inside the inner circumference of the coil 2 when viewed from above. Alternatively, the distance between the first outer insulator 61 and the inner insulator 13 in the region inside the inner circumference of the coil 2 (center of the internal magnetic body 14) when viewed from above is preferably 55 μm or more and 90 μm or less (i.e., from 55 μm to 90 μm). Likewise, the distance between the second outer insulator 62 and the inner insulator 13 in the region inside the inner circumference of the coil 2 (center of the internal magnetic body 14) when viewed from above is preferably 55 μm or more and 90 μm or less (i.e., from 55 μm to 90 μm).

Fourth Embodiment

Figure 6:
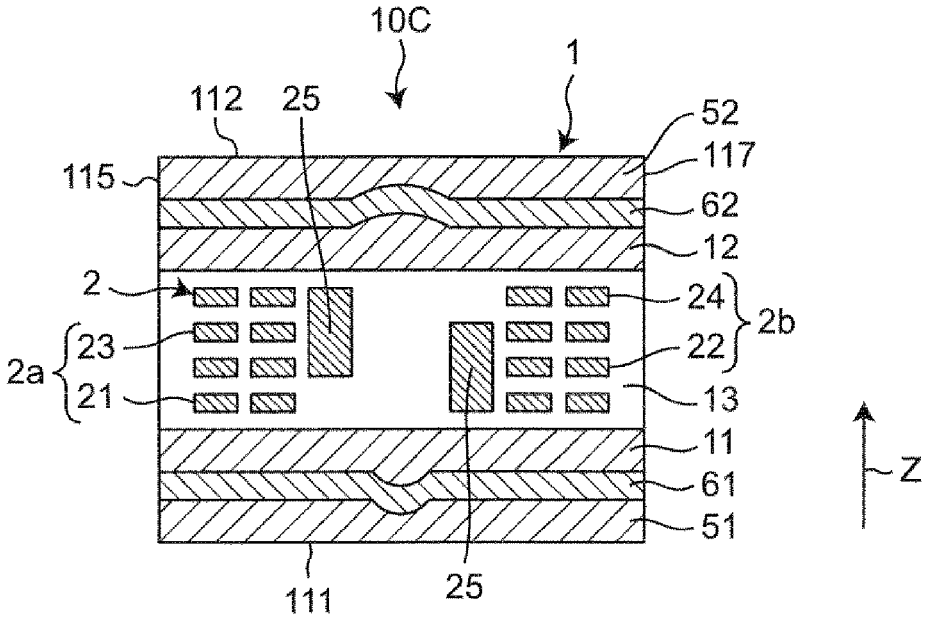
FIG. 6 is a sectional view showing a coil component according to a fourth embodiment of the present disclosure.

FIG. 6 is a sectional view showing a coil component according to a fourth embodiment of the present disclosure. The fourth embodiment is different from the third embodiment in that the coil component includes no internal magnetic body. Only the differences in the configuration will be described below. In the fourth embodiment, the same reference numerals as those in the third embodiment denote the same configurations as in the third embodiment, and explanations thereof will not be provided.

As shown in FIG. 6, a coil component 10C according to the fourth embodiment includes no internal magnetic body 14. Also, in the coil component 10C according to the present embodiment, the distance between the first outer insulator 61 and the inner insulator 13, in the region inside the inner circumference of the coil 2 when viewed from above, is larger than the distance between the first outer insulator 61 and the inner insulator 13, in the region in accord with the inner insulator 13 that is not in the region inside the inner circumference of the coil 2 when viewed from above. Likewise, the distance between the second outer insulator 62 and the inner insulator 13, in the region inside the inner circumference of the coil 2 when viewed from above, is larger than the distance between the second outer insulator 62 and the inner insulator 13, in the region in accord with the inner insulator 13 that is not in the region inside the inner circumference of the coil 2 when viewed from above. As a result, the electrical characteristics of the coil component 10C can be further enhanced while stress applied to the inner insulator 13 is reduced. When the coil component 10C is a common mode choke coil, the impedance of the common mode component can be increased to a great extent. Further, even when the distance between the outer insulator and the inner insulator is set as described above, the height of the coil component is not affected to a great extent and, therefore, a low-profile coil component can be realized at the same time.

Fifth Embodiment

Figure 7:
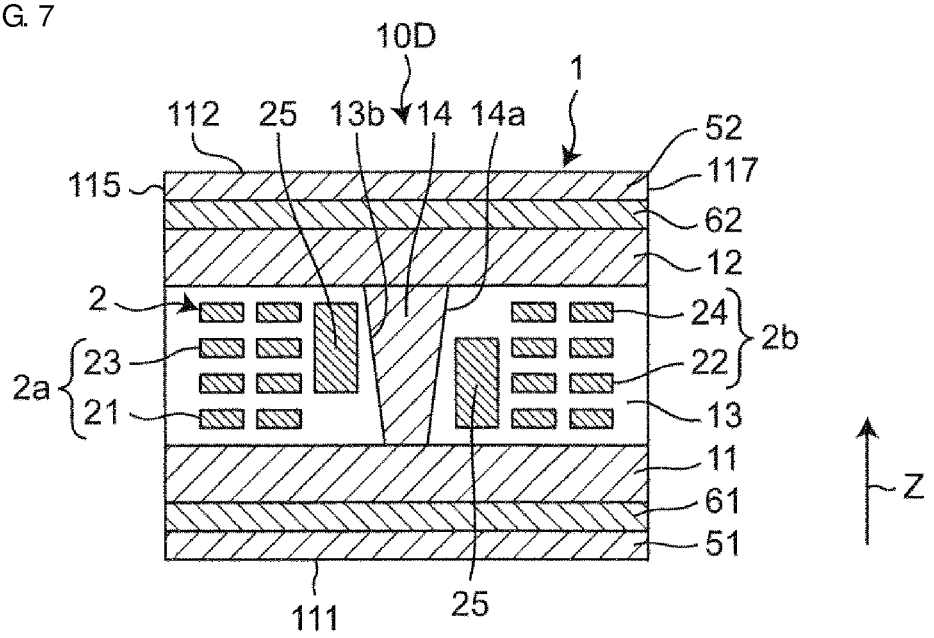
FIG. 7 is a sectional view showing a coil component according to a fifth embodiment of the present disclosure.

FIG. 7 is a sectional view showing a coil component according to a fifth embodiment of the present disclosure. The fifth embodiment is different from the first embodiment in the thickness of each of the first outer insulator 61 and the second outer insulator 62, the distance between the first outer insulator 61 and the inner insulator 13, and the distance between the second outer insulator 62 and the inner insulator 13. Only the differences in the configuration will be described below. In the fifth embodiment, the same reference numerals as those in the first embodiment denote the same configurations as in the first embodiment, and explanations thereof will not be provided.

A coil component 10D according to the present embodiment has a configuration suitable for a coil component smaller than the coil component 10 according to the first embodiment. When the coil component is reduced in size, the volume of the inner insulator itself is reduced and, therefore, stress generated during firing tends to become small. Consequently, the effect of reducing stress can be sufficiently achieved even when the thickness of the outer insulator is set to be smaller than the thickness in the first embodiment and/or the distance between the outer insulator and the inner insulator is set to be larger than the distance in the first embodiment. In addition, the electrical characteristics of the coil component can be improved by decreasing the thickness of the outer insulator and/or increasing the distance between the outer insulator and the inner insulator. The multilayer body 1 is a substantially rectangular parallelepiped having a length L of about 0.40±0.10 mm, a width W of about 0.3±0.10 mm, and a height T of about 0.30±0.05 mm.

The coil component 10D according to the fifth embodiment includes the multilayer body 1 that includes the first outer insulator 61, the first inner magnetic body 11, the inner insulator 13, the second inner magnetic body 12, and the second outer insulator 62 and the coil 2 disposed inside the inner insulator 13. The coil component 10D further includes the internal magnetic body 14 which is disposed inside the inner circumference of the coil 2 in the inner insulator 13 and which is connected to the first inner magnetic body 11 and the second inner magnetic body 12. As shown in FIG. 7, the multilayer body 1 may further include the first outer magnetic body 51 disposed on the first outer insulator 61 and the second outer magnetic body 52 disposed on the second outer insulator 62. However, the multilayer body 1 may include neither first outer magnetic body 51 nor second outer magnetic body 52.

In the present embodiment, the thickness of the first outer insulator 61 and the thickness of the second outer insulator 62 are preferably about 1 μm or more and 20 μm or less (i.e., from about 1 μm to 20 μm), and more preferably about 5 μm or more and 15 μm or less (i.e., from about 1 μm to 15 μm). Alternatively, the thickness of the first outer insulator 61 is preferably about one-twelfth or more and one-eighth or less (i.e., from about one-twelfth to one-eighth) the total thickness of the first outer insulator 61, the first inner magnetic body 11, and, when disposed, the first outer magnetic body 51. Likewise, the thickness of the second outer insulator 62 is preferably about one-twelfth or more and one-eighth or less (i.e., from about one-twelfth to one-eighth) the total thickness of the second outer insulator 62, the second inner magnetic body 12, and, when disposed, the second outer magnetic body 52. When the thickness of the outer insulator is set to be within the above-described range, stress applied to the inner insulator 13 can be reduced, the electrical characteristics of the coil component can be improved, and a low-profile coil component can be achieved.

In the present embodiment, the distance between the first outer insulator 61 and the inner insulator 13 is preferably about one-half or more the total thickness of the first outer insulator 61, the first inner magnetic body 11, and, when disposed, the first outer magnetic body 51. Likewise, the distance between the second outer insulator 62 and the inner insulator 13 is preferably about one-half or more the total thickness of the second outer insulator 62, the second inner magnetic body 12, and, when disposed, the second outer magnetic body 52. When the distance between the outer insulator and the inner insulator is set to be within the above-described range, stress applied to the inner insulator 13 can be reduced, the electrical characteristics of the coil component can be improved, and a low-profile coil component can be achieved.

Alternatively, the distance between the first outer insulator 61 and the inner insulator 13 is preferably about 37.5 μm or more. Likewise, the distance between the second outer insulator 62 and the inner insulator 13 is preferably about 37.5 μm or more. When the distance between the outer insulator and the inner insulator is set to be within the above-described range, stress applied to the inner insulator 13 can be reduced, the electrical characteristics of the coil component can be improved, and a low-profile coil component can be achieved.

The height of the multilayer body 1 of the coil component according to the present embodiment is preferably about 0.25 mm or more and 0.35 mm or less (i.e., from about 0.25 mm to 0.35 mm). When the first outer magnetic body 51 and the second outer magnetic body 52 are disposed, the distance between the first outer insulator 61 and the first end surface 111 of the multilayer body 1 is preferably about 62.5 μm or less. Likewise, the distance between the second outer insulator 62 and the second end surface 112 of the multilayer body 1 is preferably about 62.5 μm or less.

In the coil component 10D shown in FIG. 7, the distance between the outer insulator and the inner insulator is constant. However, in the same manner as in the configuration shown in FIG. 5, the distance between the first outer insulator 61 and the inner insulator 13, at the center of the internal magnetic body 14 when viewed from above, may be larger than the distance between the first outer insulator 61 and the inner insulator 13, in a region in accord with the inner insulator 13 that is not at the center of the internal magnetic body 14 when viewed from above. Likewise, the distance between the second outer insulator 62 and the inner insulator 13, at the center of the internal magnetic body 14 when viewed from above, may be larger than the distance between the second outer insulator 62 and the inner insulator 13, in the region in accord with the inner insulator 13 that is not at the center of the internal magnetic body 14 when viewed from above. According to such a configuration, the electrical characteristics of the coil component can be further enhanced while stress applied to the inner insulator is reduced. When the coil component 10D is a common mode choke coil, the impedance of the common mode component can be increased to a great extent. Further, even when the distance between the outer insulator and the inner insulator is set as described above, the height of the coil component is not affected to a great extent and, therefore, a low-profile coil component can be realized at the same time.

Sixth Embodiment

Figure 8:
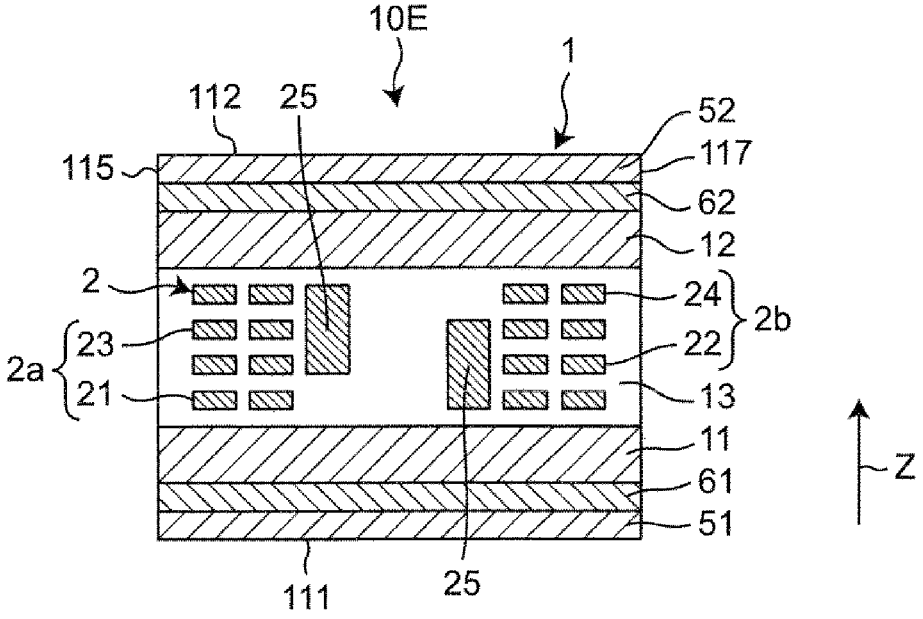
FIG. 8 is a sectional view showing a coil component according to a sixth embodiment of the present disclosure.

FIG. 8 is a sectional view showing a coil component according to a sixth embodiment of the present disclosure. The sixth embodiment is different from the fifth embodiment in that the coil component includes no internal magnetic body. Only the differences in the configuration will be described below. In the sixth embodiment, the same reference numerals as those in the fifth embodiment denote the same configurations as in the fifth embodiment, and explanations thereof will not be provided.

A coil component 10E according to the present embodiment has a configuration suitable for a coil component smaller than the coil component 10A according to the second embodiment in the same manner as the coil component 10D according to the fifth embodiment. When the coil component is reduced in size, the volume of the inner insulator itself is reduced and, therefore, stress generated during firing tends to become small. Consequently, the effect of reducing stress can be sufficiently achieved even when the thickness of the outer insulator is set to be smaller than the thickness in the second embodiment and/or the distance between the outer insulator and the inner insulator is set to be larger than the distance in the second embodiment. In addition, the electrical characteristics of the coil component can be improved by decreasing the thickness of the outer insulator and/or increasing the distance between the outer insulator and the inner insulator.

As shown in FIG. 8, a coil component 10E according to the sixth embodiment includes no internal magnetic body 14. Also, in the coil component 10E according to the present embodiment, the multilayer body 1 includes the first outer insulator 61 and the second outer insulator 62 and, therefore, stress applied to the inner insulator 13 can be reduced, the electrical characteristics of the coil component can be improved, and a low-profile coil component can be achieved. When the coil component is a common mode choke coil, the impedance of the common mode component can be increased by adopting the above-described configuration.

In the coil component 10E shown in FIG. 8, the distance between the outer insulator and the inner insulator is constant. However, in the same manner as in the configuration shown in FIG. 6, the distance between the first outer insulator 61 and the inner insulator 13, in the region inside the inner circumference of the coil 2 when viewed from above, may be larger than the distance between the first outer insulator 61 and the inner insulator 13, in a region in accord with the inner insulator 13 that is not inside the inner circumference of the coil 2 when viewed from above. Likewise, the distance between the second outer insulator 62 and the inner insulator 13, in the region inside the inner circumference of the coil 2 when viewed from above, may be larger than the distance between the second outer insulator 62 and the inner insulator 13, in the region in accord with the inner insulator 13 that is not inside the inner circumference of the coil 2 when viewed from above. According to such a configuration, the electrical characteristics of the coil component can be further enhanced while stress applied to the inner insulator is reduced. When the coil component 10E is a common mode choke coil, the impedance of the common mode component can be increased to a great extent. Further, even when the distance between the outer insulator and the inner insulator is set as described above, the height of the coil component is not affected to a great extent and, therefore, a low-profile coil component can be realized at the same time.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a multilayer body that includes a first outer magnetic body, a first outer insulator, a first inner magnetic body, an inner insulator, a second inner magnetic body, a second outer insulator, and a second outer magnetic body which are stacked sequentially in a stacking direction, such that each layer is directly connected to adjacent layers; and a coil disposed only inside the inner insulator, wherein a thickness of the first outer insulator is at least one-fifteenth of a total thickness of the first outer magnetic body, the first outer insulator, and the first inner magnetic body, a thickness of the second outer insulator is at least one-fifteenth of a total thickness of the second outer magnetic body, the second outer insulator, and the second inner magnetic body, the thickness of each of the first outer insulator and the second outer insulator is equal to or less than 20 μm, and a thickness of the inner insulator is greater than or equal to 100 μm.

2. The coil component according to claim 1, wherein a distance between the first outer insulator and the inner insulator is from one-third to one-half of a total thickness of the first outer magnetic body, the first outer insulator, and the first inner magnetic body, a distance between the second outer insulator and the inner insulator is from one-third to one-half of a total thickness of the second outer magnetic body, the second outer insulator, and the second inner magnetic body, and the thickness of the inner insulator is in a range from 110 μm to 210 μm.

3. The coil component according to claim 1, further comprising an internal magnetic body disposed inside an inner circumference of the coil in the inner insulator and connected to the first inner magnetic body and the second inner magnetic body.

4. The coil component according to claim 1, wherein a distance between the first outer insulator and the inner insulator, in a region inside the inner circumference of the coil when viewed in the stacking direction, is larger than a distance between the first outer insulator and the inner insulator in a region in accord with the inner insulator outside of the region inside the inner circumference of the coil when viewed in the stacking direction, and a distance between the second outer insulator and the inner insulator, in the region inside the inner circumference of the coil when viewed in the stacking direction, is larger than a distance between the second outer insulator and the inner insulator in the region in accord with the inner insulator outside of the region inside the inner circumference of the coil when viewed in the stacking direction.

5. The coil component according to claim 3, wherein the first inner magnetic body, the second inner magnetic body, and, when disposed, the first outer magnetic body, the second outer magnetic body, and the internal magnetic body, contain Ni—Cu—Zn-based ferrite, and the first outer insulator and the second outer insulator contain alkali borosilicate glass.

6. The coil component according to claim 1, including an internal magnetic body, and a width of the internal magnetic body increases continuously from the first inner magnetic body to the second inner magnetic body.

7. The coil component according to claim 1, the coil including a plurality of coil conductors, and the coil component including a connection conductor positioned directly between a left side of the plurality of coil conductors and a right side of the plurality of coil conductors when the coil component is viewed in a sectional view extending through the plurality of coil conductors and the connection conductor.

8. A coil component comprising:

a multilayer body that includes a first outer magnetic body, a first outer insulator, a first inner magnetic body, an inner insulator, a second inner magnetic body, a second outer insulator, and a second outer magnetic body which are stacked sequentially in a stacking direction; and a coil disposed inside the inner insulator, wherein a thickness of each of the first outer insulator and the second outer insulator is from 10 μm to 20 μm, and a thickness of the inner insulator is greater than or equal to 100 μm.

9. The coil component according to claim 8, wherein a distance between the first outer insulator and the inner insulator is from 55 μm to 75 μm, a distance between the second outer insulator and the inner insulator is from 55 μm to 75 μm, and the thickness of the inner insulator is in a range from 110 μm to 210 μm.

10. The coil component according to claim 8, further comprising an internal magnetic body disposed inside an inner circumference of the coil in the inner insulator and connected to the first inner magnetic body and the second inner magnetic body.

11. The coil component according to claim 8, wherein a distance between the first outer insulator and the inner insulator, in a region inside the inner circumference of the coil when viewed in the stacking direction, is larger than a distance between the first outer insulator and the inner insulator in a region in accord with the inner insulator outside of the region inside the inner circumference of the coil when viewed in the stacking direction, and a distance between the second outer insulator and the inner insulator, in the region inside the inner circumference of the coil when viewed in the stacking direction, is larger than a distance between the second outer insulator and the inner insulator in the region in accord with the inner insulator outside of the region inside the inner circumference of the coil when viewed in the stacking direction.

12. The coil component according to claim 10, wherein the first inner magnetic body, the second inner magnetic body, and, when disposed, the first outer magnetic body, the second outer magnetic body, and the internal magnetic body, contain Ni—Cu—Zn-based ferrite, and the first outer insulator and the second outer insulator contain alkali borosilicate glass.

13. The coil component according to claim 8, including an internal magnetic body, and a width of the internal magnetic body increases continuously from the first inner magnetic body to the second inner magnetic body.

14. The coil component according to claim 8, the coil including a plurality of coil conductors, and the coil component including a connection conductor positioned directly between a left side of the plurality of coil conductors and a right side of the plurality of coil conductors when the coil component is viewed in a sectional view extending through the plurality of coil conductors and the connection conductor.

15. A coil component comprising:

a multilayer body that includes a first outer insulator, a first inner magnetic body, an inner insulator, a second inner magnetic body, and a second outer insulator which are stacked sequentially in a stacking direction, such that each layer is directly connected to adjacent layers; and a coil disposed only inside the inner insulator, wherein a thickness of each of the first outer insulator and the second outer insulator is from 1 μm to 20 μm, and a thickness of the inner insulator is in a range from 160 μm to 338 μm.

16. The coil component according to claim 15, wherein the multilayer body further includes a first outer magnetic body disposed on the first outer insulator, and a second outer magnetic body disposed on the second outer insulator.

17. The coil component according to claim 15, further comprising an internal magnetic body disposed inside the inner circumference of the coil in the inner insulator and connected to the first inner magnetic body and the second inner magnetic body.

18. The coil component according to claim 17, wherein the first inner magnetic body, the second inner magnetic body, and, when disposed, the first outer magnetic body, the second outer magnetic body, and the internal magnetic body, contain Ni—Cu—Zn-based ferrite, and the first outer insulator and the second outer insulator contain alkali borosilicate glass.

19. The coil component according to claim 15, including an internal magnetic body, and a width of the internal magnetic body increases continuously from the first inner magnetic body to the second inner magnetic body.

20. The coil component according to claim 15, the coil including a plurality of coil conductors, and the coil component including a connection conductor positioned directly between a left side of the plurality of coil conductors and a right side of the plurality of coil conductors when the coil component is viewed in a sectional view extending through the plurality of coil conductors and the connection conductor.

* * * * *